United States Patent [19]

Gast et al.

[11] Patent Number: 4,887,450

[45] Date of Patent: Dec. 19, 1989

[54] FASTENER STEM COLLECTION APPARATUS AND METHOD

[75] Inventors: Robert L. Gast, Tustin; Lyle V. Willits, Costa Mesa, both of Calif.

[73] Assignee: Textron, Inc., Providence, R.I.

[21] Appl. No.: 175,523

[22] Filed: Mar. 31, 1988

[51] Int. Cl.[4] ..... B21D 31/00

[52] U.S. Cl. ..... 72/391; 72/453.17

[58] Field of Search ..... 72/391, 453.17, 453.19, 72/114; 29/243.53; 227/156, 127

[56] References Cited

U.S. PATENT DOCUMENTS

| | | | |
|---|---|---|---|
| 4,027,520 | 6/1977 | Klien | 72/391 |
| 4,062,217 | 12/1977 | Ebbert et al. | 72/391 |
| 4,137,747 | 2/1979 | Clarke et al. | 72/391 |
| 4,259,858 | 4/1981 | Freeman et al. | 72/391 |
| 4,275,582 | 6/1981 | Sheffield et al. | 72/391 |
| 4,275,583 | 6/1981 | Gilbert et al. | 72/391 |
| 4,281,531 | 8/1981 | Ehmann et al. | 72/391 |
| 4,454,746 | 6/1984 | Schwab | 72/391 |
| 4,515,005 | 5/1985 | Klein | 72/453.17 |
| 4,598,571 | 7/1986 | Oefinger | 72/391 |

FOREIGN PATENT DOCUMENTS

| | | | |
|---|---|---|---|
| 2154788 | 5/1973 | Fed. Rep. of Germany | 72/391 |
| 2116102 | 9/1983 | United Kingdom | 72/391 |

OTHER PUBLICATIONS

A copy of the "Operating and Service Instructions with Spare Parts List" for the Gesipa Pneumatic Hydraulic Blind Riveting Tool PH 2000 no date.

A cross-sectional drawing of the Gesipa PH 2000 tool no date.

*Primary Examiner*—David Jones

*Attorney, Agent, or Firm*—Knobbe, Martens, Olson & Bear

[57] ABSTRACT

A fastener stem collection device for attaching to a power operated fastening device for collecting fastener stems, having a reciprocating tube urged forward by air pressure against the fastening device, which tube has an air jet for introduction of pressurized air to its central bore to draw the fastener stem from the fastening device through the central bore and deliver it to a collection housing. The collection housing has a non-opaque inner tube with an open rear end, and an outer canister with a closed rear end and an open window located medially thereon. The outer canister is selectively affixable in a concentric relation with the inner tube to collect the stems during operation of the fastening device, but may be released and slid rearward of the inner tube to allow the collected stems to be discharged through the inner tube open end and out the outer canister window. During operation, the amount of stems in the inner tube may be determined visually by viewing through the outer canister window and the non-opaque inner tube.

13 Claims, 2 Drawing Sheets

10
12
14
16
18
19
20
22
23
24
25
26
30
32
34
36
40
54
60
62
64
66
70
72
73
74
85
86
94
100
114
116
122
124
130
134
136
140
142
144
150
154
156
160
162
164
170
172
176
2
4
5

FASTENER STEM COLLECTION APPARATUS AND METHOD

FIELD OF THE INVENTION

This invention relates to power operated fastening devices, and in particular, to an apparatus to be attached to such a device for collecting the broken off fastener stems and a method for collecting broken off fastener stems.

BACKGROUND OF THE INVENTION

A blind rivet has an outer, normally tubular body formed with an enlarged head at the "head" end and provided internally with a mandrel passing through the body having an enlarged head at the "tail" end of the body and a thin cylindrical stem protruding beyond the tail end of the body. In use, the rivet is typically placed in the riveting head of a power riveter and directed to the workpiece. In other instances, the rivet is placed in the workpiece and the tool then applied to it. The mandrel is gripped by a chuck of the riveting head, which is then operated to pull the chuck away from a fixed tip of the riveting head, thereby pulling the head of the mandrel against the tail end of the body to deform the tail end of the rivet body thereby forming a blind head. The rivet is constructed so that the mandrel stem breaks off inside the body when a predetermined load limit corresponding to a predetermined deformation of the rivet is reached. Similarly, the rivet may be set by the automatic riveter by rotating the mandrel, thereby breaking off the mandrel upon reaching a predetermined rotational stress limit.

In either event, the broken stem is allowed to exit rearward through a passage in the riveting head. In the case of a riveter which pulls the mandrel to separate the stem, the stem is abruptly pulled and released, expelling it from the riveting head through the passage In the typical power riveter of this type, the riveting head is actuated by a head piston The head piston may have attached thereto a rearwardly extending piston rod, or it may reciprocate on a stationary expulsion tube. The passage through which the stem exits the riveting head is directed through the piston and either the reciprocating piston rod or the stationary central expulsion tube.

In a power riveter of the pulling type, the stem can be expelled from the rear end of the riveting head with such force that it could penetrate soft tissue upon impact Even a stem which merely falls from the riveting head could strike the eye of a worker who is riveting overhead, potentially causing serious injury. Thus, it is known to augment the rear of the riveting head with a deflector for deflecting the stem away from the worker and down toward the riveter base. The drawback of using such a deflector is that the stems merely fall from the tool to the floor so that they must be cleaned up. Moreover, stems falling into the workpiece may damage the workpiece and stems falling onto the floor pose a danger to the operator or anyone else walking in the area. Accordingly, it is recognized that broken-off rivet mandrel stems should be collected and disposed of so as to avoid such hazards.

The most rudimentary means of avoiding the dangers of falling mandrel stems is to place a collecting bag over the end of the riveting head. Although such bags avoid the problems of falling stems, they engender problems of their own. Collecting the stems in close proximity to the riveting head allows the stems to fall back into the passage leading from the riveting head. Thus, stems tend to stack up and jam the passage through the head piston and piston rod. This malfunction can lead to costly downtime for unjamming and other repair.

An improved collection "bag" is disclosed in U.S. Pat. No. 4,137,747. The '747 collection device consists of a pair of concentric cylinders attached to the rear end of the riveting head. The cylinders have closed rear ends and normally nonaligned apertures and the outer cylinder is rotatable around the inner cylinder so that the apertures may be aligned, thereby allowing the collected stems to be discharged. The '747 collection device suffers from the same drawback as collection bags, that the stems tend to stack up and clog in the riveting head, although to a lesser extent. Another drawback is that the aperture is smaller than the cross-sectional area of collected stems, the result of which is that the operator must shake the riveter violently to discharge the stems out the aligned apertures because they are jammed together. One advantage over the collector bag is that the '747 device is taught as being made of clear plastic so that the operator can determine when the device is full of stems before the riveter stops working due to clogging. On the other hand, because non-opaque polymeric materials do not at this time have the scratch resistance to withstand the abuse directed to industrial tools, this benefit is of little lasting value.

It is known in the art to augment power riveters with a vacuum mandrel stem collection device for drawing the stems out of the riveting head and collecting them in a location either remote from the riveting head, as shown in U.S. Pat. Nos. 4,275,582 and 4,275,583, or adjacent to the riveting head as shown in U.S. Pat. No. 4,281,531.

The prior art recognized disadvantages in collecting mandrels at a location remote from the riveting head. Most importantly, such a scheme necessitated use of an additional hose from the power riveter to the remote collection site. The additional hose enhances the possibility of the worker entangling the riveter hoses with the workpiece or other objects, an inconvenient and potentially dangerous situation. Further, the additional hose may limit the reach of the device, the freedom of movement of the device and its access into confined areas or workpieces. Accordingly, the art has striven to locate the stem collection device adjacent the rear end of the riveting head. This location provides an additional important benefit. The stem striking the inside of the collector upon being expelled from the riveting head makes an audible noise. The worker using the power riveter uses this audible noise as an indication that the rivet stem has cleared the rivet head, freeing the rivet head for insertion of a new rivet. Accordingly, the worker uses the sound of the stem hitting the collection device to indicate when to remove the power riveter from the workpiece and place another rivet in the tip or on the workpiece, starting a new rivet cycle.

The most common rivet stem collection arrangement is shown in U.S. Pat. No. 4,281,531. This device has a storage canister located behind and directly adjacent to the riveting head. The canister has an end cap with a jet pump. A separate air line from the compressed air source is directed to the end cap and the pressurized air is directed through the passage in the end cap and expelled to the outside, thereby creating a vacuum in the storage canister which acts to suck the stem from the riveting head into the storage compartment. This design has multiple drawbacks. First, the removable end cap poses a safety hazard. If the power riveter is operated with the end cap removed, the falling or projected rivet stem may strike and injure the operator. Second, such systems collect in their jet pump orifices debris which has been carried by the vacuum along with the stems. Accordingly, such devices must be provided with a filter in order to prevent the jet pump from clogging. These filters are expensive to install and maintain.

SUMMARY OF THE INVENTION

The fastener stem collection apparatus of the present invention includes a housing which is affixed to the power riveter riveting head by means of an expandable collet, an ejection tube disposed within said housing, an inner collector tube fixed to the housing in communication with the ejection tube and an outer canister arranged about the inner collector tube selectively engageable with the housing so as to prevent relative linear movement. The canister blocks the inner collector tube rear aperture from passage of the stems but allows escape of the pressurized air. It is also disengageable to allow the outer canister to be moved linearly backward away from the riveting head so as to open the inner collector tube rear aperture and allow the stems to fall into the outer canister and exit out a canister side window.

The ejection tube is slidably disposed within the housing so that there is formed between the ejection tube and housing an annulus sealed at both ends from air leakage. Compressed air from an external source is introduced through the housing into the annulus, thereby urging the enlarged forward end of the ejection tube forward against the piston rod or expulsion tube of the riveting head depending on the type of riveter. This arrangement is an air spring, keeping the ejection tube in contact either with the reciprocating piston rod or the stationary expulsion tube, thereby forming a continuous passage through which the stems may pass without interruption.

The ejection tube has formed in its side between the front and rear seals an air jet passage which acts to direct pressurized air from the annulus rearward through the ejection tube and out into the inner collector tube. This air flow acts to suck the stem from the riveting head and project it into the inner collector tube. The ejected stems pass to the inner collector tube open rear end and strike the outer canister rear end, which is preferably covered by a metallic end plate. The metallic end plate acts to reduce wear and impact on the outer canister body and provides an audible sound when a larger stem strikes the rear end of the outer canister. This sound is helpful to some operators as an indication that the stem has cleared the riveting head, thereby freeing the riveting head for insertion of a new rivet.

The collected stems build up in the inner collector tube until the operator decides to empty the container. The operator can tell when to empty the collector by viewing through the window in the outer canister and through the non-opaque inner collector tube the level of stems. The two-piece arrangement of the collector, along with the use of transparent material in the inner collector tube and tough, durable opaque material for the outer canister enables simultaneous achievement of two preferred characteristics, visual indication of the stem level in the collector and long service life of the outer housing.

In order to discharge the collected stems, the operator simply unscrews the outer canister from its engagement with the housing, and pulls it linearly rearward. This action pulls the canister rear end away from the inner collector tube open rear end allowing the collected stems to pass from the inner collector tube to the cavity defined by the outer canister. Because the outer canister is of considerably greater volume than the inner collector tube, the stems will easily slide from the inner tube to the outer canister, regardless of how densely nested they have become. Moving the nested mass of stems to the outer canister of greater volume allows the stems to loosen and fall freely through the outer canister window, the width of which is preferably equal to or greater than the inside diameter of the inner tube. This feature obviates the need for violent shaking of the entire riveter in order to dislodge the nested stems, allowing discharge of the stems from the collection device. Because a power riveter of the kind disclosed may weigh around eight pounds, a requirement of violently shaking the riveter to discharge the collected stems will necessarily lead to worker fatigue before the end of a shift.

The jet pump design of this invention obviates the need for the filter of the end cap jet pump design of the prior art. The jet pump orifice of the present invention is disposed within the reciprocating ejection tube. The stems being ejected through the ejection tube act to wipe the ejection tube and jet pump orifice free of debris. The debris is collected downstream of the jet pump orifice in the inner collector tube.

The two-piece collector container arrangement has an additional advantage in that it is considerably safer than the prior art end cap type vacuum devices. While in the prior art devices the end cap could be removed, exposing the operator to impact by an unobstructed stem, the present invention ensures that no stem can escape the collector undeflected, even when the collector is in the open position.

While the air supply hose of the present invention is relatively short, leading from the tool air inlet to an air fitting ring proximate the rear end of the riveting head, the convenience of such an arrangement is further enhanced by the present invention's feature of an indexable air fitting ring which allows the air fitting ring to be rotated with respect to the riveter, which in turn allows placement of the air supply hose on either side of the operator's hand and arm. This feature is particularly important in modes of use in which the operator is required to perform riveting tasks in a variety of orientations with respect to his or her body.

DETAILED DESCRIPTION OF THE PREFERRED EMBODIMENT

Figures 1, 2, 6:
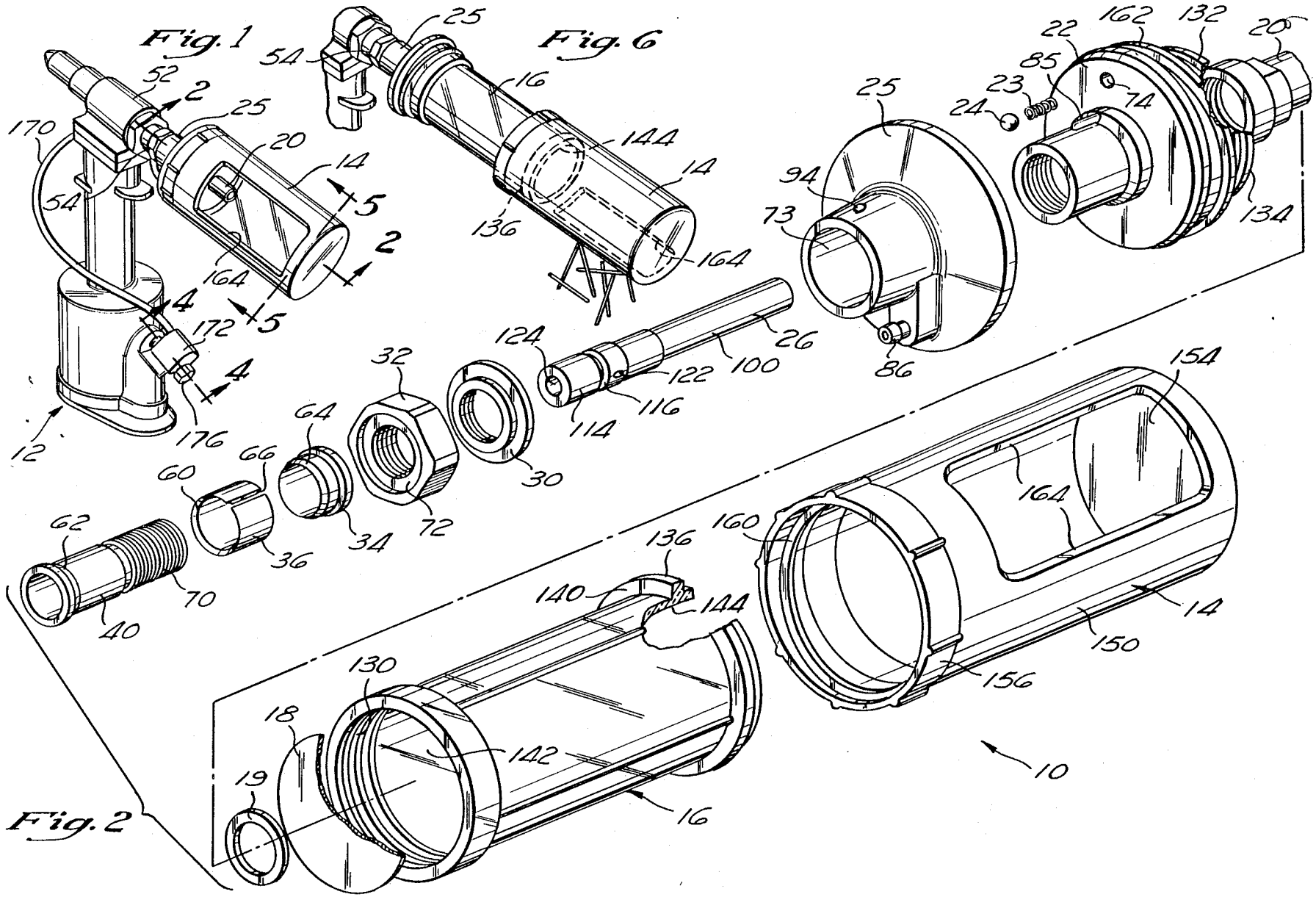
FIG. 1 is a perspective view of the stem collector of the present invention attached to a power riveter.
FIG. 2 is a an exploded perspective view of the stem collector on line 2—2 of FIG. 1.
FIG. 6 is a perspective view of the stem collector in the open position.

The stem collector 10 of the present invention is configured to be attached to a power riveter 12 as shown in FIG. 1. As shown more clearly in FIG. 2, stem collector 10 comprises an outer canister 14, an inner collector tube 16, protector plate 18, dampener 19, cap 20, housing 22, spring 23, ball 24, air fitting ring 25, ejection tube 26, retaining nut 30, jam nut 32, sleeve 34, split ring 36 and expansion mandrel 40.

Figure 3:
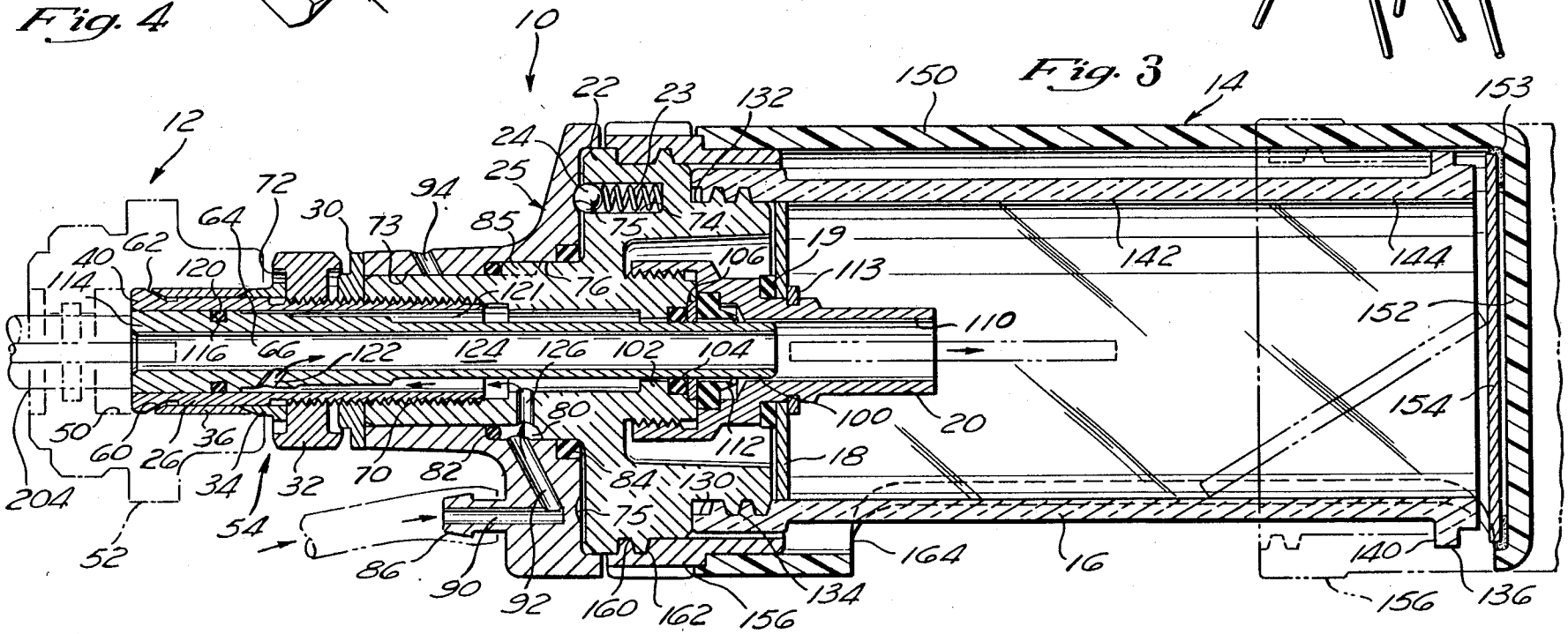
FIG. 3 is cross-sectional view of the stem collector of FIG. 1.

As shown in FIG. 3, stem collector 10 is attached to the exit bore 50 of the riveting head 52 of the power riveter 12. Stem collector 10 is attached by means of a collet assembly 54 made up of the expansion mandrel 40, split ring 36, sleeve 34, and jam nut 32. Split ring 36 is assembled over expansion mandrel 40 so that its beveled leading edge 60 abuts expansion mandrel beveled trailing edge 62. Sleeve 34 is assembled over expansion mandrel 40 so that sleeve beveled leading edge 64 abuts split ring beveled trailing edge 66. Jam nut 32 is then threaded on to the external threads 70 on the rear end of expansion mandrel 40. The forward face 72 of jam nut 32 urges sleeve 34 forward as jam nut 32 is tightened. Tightening jam nut 32 thereby forces expansion mandrel beveled trailing edge 62 and sleeve beveled leading edge 64 together against split ring beveled leading edge 60 and split ring beveled trailing edge 66 so that split ring 36 is circumferentially expanded. The circumferential expansion of split ring 36 securely fastens stem collector 10 to riveting head exit bore 50. The inventor has found it advantageous to form the components of the collet assembly of steel.

Stem collector 10 may be conveniently removed from power riveter 12 by loosening jam nut 32, which allows the radial concentric stress on split ring 36 to urge sleeve 34 rearward so that split ring 36 circumferentially contracts. The contraction of split ring 36 frees the collet assembly 54 from the riveter exit bore 50. One of skill in the art will recognize that the stem collector of the present invention may be attached to a power riveter by a number of means other than the collet assembly described.

Threaded onto expansion mandrel threads 70 behind jam nut 32 is retaining nut 30. Placed against retaining nut 30 about expansion mandrel 40 is air fitting ring 25. Threaded on to expansion mandrel threads 70 within bore 73 of air fitting ring 25 is housing 22. The housing 22 may be bonded to the expansion mandrel 40 at threads 70, for example by a suitable adhesive, to preclude them from vibrating loose.

Housing 22 has provided therein a spring cavity 74 for receiving spring 23 and ball 24. The opposing face of air fitting ring 25 has provided therein detents 75 for selective engagement with ball 24. Air fitting ring 25 is thus rotatable about housing 22 and may be locked into various positions by means of the detent arrangement.

Behind bore 73, air fitting ring 25 has an enlarged bore 76, which forms outer annulus 80 when assembled against housing 22. Outer annulus 80 is sealed at its forward end by an O-ring or other element forming a forward seal 82 and at its rear end by rear seal 84. Rear seal 84 is retained within a counterbore formed by the corners of the adjacent housing 22 and air fitting ring 25. Front seal 82 may be held in place by a projecting rib or nose 85. Only two such ribs or noses are needed to keep front seal 82 in place. One of skill in the art will recognize that front seal 82 could also be kept in place by a groove or retaining ring. Air fitting ring 25 has projecting forward therefrom an air fitting 86, such as, for example, the conventional hose barb shown in FIGS. 2 and 3. Passing through the air fitting ring hose barb 86 is air fitting passage 90. Intersecting and connecting air passage 90 with outer annulus 80 is diagonal air passage 92. Diagonal air passage 92 may be cast in the air fitting ring 25 so that the die leaves a diagonal aperture 94 in the forward portion of air fitting ring 25. Diagonal aperture 94 may be plugged for cosmetic reasons or to prevent dirt from entering.

Ejection tube 26 may be inserted through the front end of expansion mandrel 40. Ejection tube 26 has a generally cylindrical outer surface having a rear portion 100 of a diameter suited to be slidably received through neck 102 of housing 22. Adjacent housing neck 102 is back seal 104, which sealingly engages ejection tube rear portion 100. Back seal 104 is retained adjacent housing neck 102 by retaining spacer 106. Back seal 104, as well as seals 82, 84 and 120, may conveniently be provided as an O-ring.

Threaded on to the rear end of housing 22 is cap 20. Cap 20 is preferably metallic and may be bonded to housing 22 by a suitable adhesive. Cap 20 has an aperture 110 therethrough providing a clearance fit for passage of ejection tube 26. Housed within cap 20 between cap aperture 110 and back seal retaining spacer 106 is wiper 112. Wiper 112 may be a rubber or urethane product as shown, or a combination of rubber or urethane and metal as is commonly known. Wiper 112 prevents debris from the ejected stems from entering between ejection tube 26 and housing 22.

Protector plate 18 is placed around the cap 20, adjacent dampener 19, and proximate the housing 22. Protector plate 18 is retained in position by retaining ring 113. Protector plate 18 prevents the collected stems from contacting and abrading the forward portion of cap 20 and interior of housing 22. Cap 20 extends beyond protector plate 18 into the interior of inner collector housing 16 so as to reduce the opportunity for stems to fall or rebound back into ejection tube central bore 124, thereby causing the stems to stack up and jam. Dampener 19 operates to reduce the noise level from stems striking protector plate 18. Dampener 19 is preferably made of a suitable elastomer, such as rubber or urethane. Dampener 19 is preferably preloaded in compression by protector plate 18 and retaining ring 113. The preloading further reduces vibrations of, and thus the noise from, protector plate 18.

Ejection tube 26 has an enlarged front portion 114 with a groove 116 formed therein for acceptance and retention of front seal 120. Ejection tube 26, housing 22 and expansion mandrel 40 form an inner annulus 121 between front seal 120 and back seal 104. Jet passage 122 communicates from inner annulus 121 through ejection tube 26 into ejection tube central bore 124, preferably at an angle of approximately 45° with respect to the tube axis, toward the rear portion 100 of the tube 26. Inner annulus 121 is connected to outer annulus 80 by passage 126, thereby allowing free and continuous flow from air fitting 86 to ejection tube central bore 124.

Inner collector tube 16 has a front internal bore 130 configured for attachment to rear outer surface 132 of housing 22. As shown in FIGS. 2 and 3, this configuration of internal bore 130 and outer surface 132 may include threads 134 of a relatively steep pitch, for example, an 8 UN-2A Acme thread with at least one full thread. The mating threads may be ultrasonically bonded to ensure that they will not vibrate loose. Preferably, however, they are not bonded so firmly as to prevent their disengagement for overhaul purposes. The rear end of inner collector tube 16 has an enlarged outer surface 136 forming forward facing stop surface 140. Inner collector tube central bore 142 is preferably smooth and cylindrical and is directed out rear aperture 144 without obstruction.

Outer canister 14 is an assembly including the canister body 150 which is generally tubular and has a closed rear end 152. Recessed in and attached to the inside of outer canister rear end 152 is end plate 154. End plate 154 is preferably made of steel to enhance both the sound of the stem striking the end plate 154 and its resistance to wear. End plate 154 may be attached to canister rear end 152 by a number of suitable means, including the adhesive pad 153 shown, rivets, screws and a retainer ring. After enlarged outer rear surface 136 of inner connector tube 16 is placed inside outer canister body 150, the outer canister assembly 14 is completed by attaching to the body 150 the canister mounting ring 156. Canister mounting ring 156 is preferably permanently adhered to canister body 150, for example, by ultrasonically joining together both parts. After assembling the inner collector tube 16 and outer canister assembly 14, the inner collector tube 16 is affixed to housing rear outer surface 132, for example, by engagement of mating threads 134 and adhesive bonding. Outer canister 14 may then be selectively engaged and disengaged to housing 22 by any of a number of means. Preferably, canister mounting ring 156 has formed therein threads 160 which mate with threads 162 on the exterior of housing 22. The threads may advantageously be quick engaging threads of a relatively steep pitch, for example, 8 UN-2A Acme double-lead threads.

Outer canister body 150 has a window 164 formed in one side thereof. The width of window 164 preferably equals or exceeds the inside diameter of inner collector tube 16.

While inner collector tube 16 is preferably made of a transparent or otherwise non-opaque plastic material, such as a clear grade plexiglas acrylic, outer canister 14 is preferably constructed of an opaque material with great toughness, impact strength and scratch resistance. The material should provide the toughness, impact strength and scratch resistance necessary to allow a tool to withstand abrasions and impact through the rough handling encountered in industrial applications. The preferred material is Triax No. 1180, made by Monsanto Chemical Co. One of ordinary skill in the art will appreciate that other materials will perform well, including super-tough nylons and other high impact-resistant polymers. The air fitting ring 25 may conveniently be made of the same material as the outer canister 14.

Figure 4:
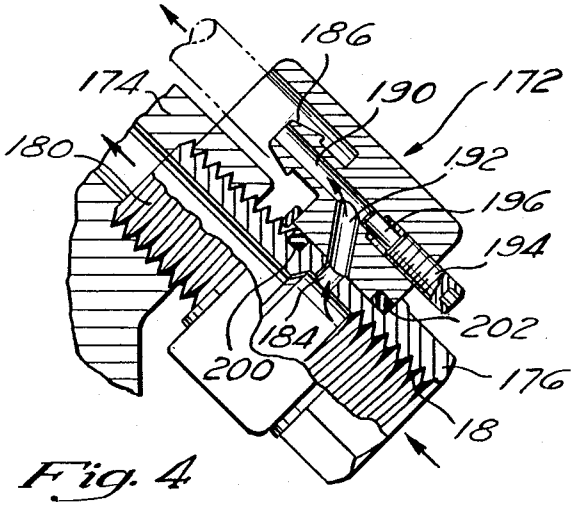
FIG. 4 is a cross-sectional view of the inlet air control on line 4—4 of FIG. 1.

Referring to FIG. 1, the air supply is introduced to air fitting ring 25 via hose 170 from air inlet swivel 172. Referring to FIG. 4, air inlet swivel 172 is interposed between power riveter body 174 and main air line fitting 176. Main air line fitting 176 has male threaded portion 180 for insertion into power riveter body 174 and female threaded portion 182 for acceptance of the air line from the air supply (not shown). Between main air line fitting male thread portion 180 and main air line fitting female thread portion 182 is air takeoff passage 184. Rotatably arranged about air line fitting 176 is air inlet swivel 172. Air inlet swivel 172 has provided thereon an air fitting 186, which may be a simple hose barb as shown. Extending through air fitting 186 is central passage 190. Connecting central passage 190 with air takeoff passage 184 is connecting passage 192. Threadably engaged at the end of central passage 190 is metering screw 194. Adjustment of metering screw 194 forward from the position shown in FIG. 4 causes metering screw tip 196 to partially obstruct connecting passage 192, thereby reducing the amount of air diverted from the main air line into central passage 190. Escape of air from air takeoff passage 184 and connecting passage 192 is prevented by front swivel seal 200 and rear swivel seal 202.

The air flow adjustment of metering screw 194 is preferably provided at a location remote from the stem collector 10 so as to reduce the effect of turbulence created by the metering screw 194. Air line 170 may be advantageously provided with a separate ON/OFF valve (not shown), such as a simple clip, to allow the operator to shut off the air flow to the collector without disturbing the calibration of the metering screw 194.

When air is introduced from the main air supply to power riveter 12 via main air line fitting 176, a portion of the compressed air entering the riveter is diverted by air inlet swivel 172 through air takeoff passage 184 connecting passage 192 and central passage 190 to air hose 170. The amount of air diverted may be adjusted by use of metering screw 194. Advancement of metering screw 194 causes metering screw tip 196 to obstruct connecting passage 192, thereby reducing the volume of air diverted from the main line. The volume of air required to create a vacuum to draw the stem from the riveting head 52 depends upon the relative size of the stem as compared to the ejection tube central bore 124. If the stem diameter is close to the inner diameter of the ejection tube central bore 124, a relatively small amount of air will be required. If, on the other hand, the diameter of the stems is substantially smaller than the ejection tube central bore 124, a correspondingly large volume of air will need to be diverted.

The usual operating air supply pressure for power riveters is 85–125 psi. Designing for a minimum 55 psi air supply pressure and up to ¼" nominal size rivets (0.197 inch stem diameter), it has been found that a jet passage of 0.063 inch diameter disposed at approximately 45° with respect to the tube axis toward the collector and an ejection tube of 0.209 inch inside diameter extending 2 to 3 inches back from the jet passage is preferred. The ejection tube inside diameter may be reduced for smaller sized rivets, in which case the jet passage diameter could also be reduced.

The air supply from air hose 170 enters air fitting ring 25 via air fitting ring hose barb 86. The air proceeds through air fitting passage 90 and diagonal air passage 92 into outer annulus 80. Air fitting ring 25 is indexable about housing 22 by means of a detent comprising ball 24, spring 23 and detents 75. Thus, the position of air hose 170 may be adjusted so as to fall on either side of the operator's hand or arm.

Because outer annulus 80 is sealed by forward seal 82 and rear seal 84, the compressed air from air hose 170 proceeds through outer annulus 80 via passage 126 into inner annulus 121, which is formed between housing 22 and expansion mandrel 40 on the outside and ejection tube 26 on the inside. The length of inner annulus 121 varies depending on the position of ejection tube 26. Ejection tube 26 has a front portion 114 which is of a larger outer diameter than its rear portion 100. This difference in diameter and concomitant difference in reactive area upon which the pressure can act causes the air pressure within inner annulus 121 to urge ejection tube 26 forward toward riveting head 52. Ejection tube 26 will move forward until it contacts either the reciprocating piston rod of the riveting head or the stationary expulsion tube of the riveting head, both shown as part 204 in FIG. 3, depending on the riveting head design. The ejection tube 26 is thus driven by the compressed air in the fashion of an air spring so that it always contacts the adjacent member 204 of the riveting head 52. This air spring feature allows the creation of a continuous passage through which the stems may proceed without interruption or obstruction.

The ejection tube central bore 124 is in fluid communication with inner annulus 121 by means of jet passage 122. Air from jet passage 122 enters central bore 124 and is expelled rearward therethrough into inner collector tube 16. This jet pump action creates a vacuum forward of jet passage 122 which draws stems from the riveting head. Having the jet passage angled rearwardly enhances this jet pump action. The stems act to wipe the ejection tube central bore free of accumulated dirt and debris. This wiping action prevents buildup of dirt and debris which could block jet passage 122 and ejection tube central bore 124. The dirt and debris are thus forced into inner collector tube 16 along with the stems. As each stem is expelled from the ejection tube 26 by means of the air pressure, it passes rearward the length of the inner collector tube 16 through the inner tube rear aperture 144 where it strikes end plate 154. In so doing, the stem causes an audible noise, thereby alerting the operator that the stem has cleared the riveting head 52, allowing insertion of a new rivet. After striking end plate 154, the stem rebounds into inner collector tube 16. The stems accumulate in inner collector tube 16 until the operator wishes to discharge the stems. The operator can determine when to discharge the stems by looking through outer canister window 164 and through the non-opaque inner collector tube 16 to determine the level of stems in the inner collector tube. If the inner collector tube 16 is full or nearing full, the operator will want to discharge the stems. To do so, the operator rotates outer canister 14, thereby disengaging threads 160, 162. Upon disengagement of threads 160, 162, the operator linearly retracts the outer canister 14 to the position shown in FIG. 6. The end of the linear stroke is reached when canister mounting ring 156 abuts inner collector tube stop surface 140. In that position, the obstruction of the inner collector tube rear aperture 144 by the outer canister closed rear end 152 is thereby removed, allowing the collected stems to slide out of inner collector tube 16 into the cavity formed by outer canister 14. Because the interior volume of outer canister 14 is greater than the interior volume of inner collector tube 16, the stems slide freely regardless of the extent to which they may be nested.

Figure 5A:
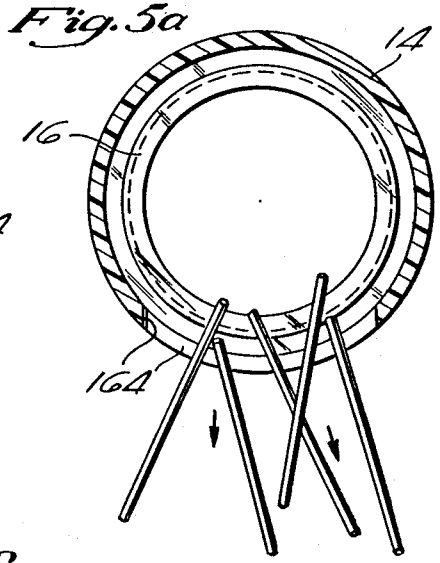
FIG. 5*a* is a cross-sectional view of the collector housing in the open position.
Figure 5:
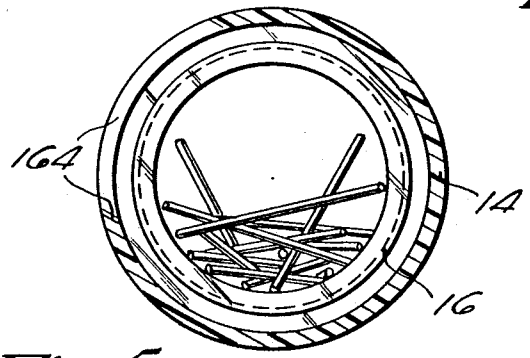
FIG. 5 is a cross-sectional view of the collector housing in the closed position on line 5—5 of FIG. 1

Upon entering outer canister 14, the stems encounter outer canister window 164. The width of outer canister window 164 is preferably equal to or greater than the inside diameter of inner collector tube !6. This relationship enables the stems, regardless of how tightly compacted, to freely fall through the window 164. The operator need not shake the tool violently to dislodge the nested stems. The relationship between the inner diameter of the inner collector tube 16 and the window 164 of outer canister 14 is shown in FIGS. 5 and 5*a*. In FIG. 5, the stems are shown nested in the inner collector tube 16. In FIG. 5*a*, the outer canister 14 is shown in its open position with the stems freely falling out window 164.

When the stem collector 10 is in the closed position, shown in FIG. 1, the compressed air is allowed to escape from the inner collector tube by flowing through inner tube rear aperture 144, around enlarged outer rear surface 136 and through window 164. When the stem collector 10 is in the open position, as shown in FIG. 6, the compressed air in the inner collector tube 16 flows through inner tube rear aperture 144 and out outer canister window 164. In either position, suspended particles of dirt and debris are blown out through window 164. This action, along with the wiping action of the stems in the ejection tube central bore 124, renders the stem collector 10 of the present invention essentially self-cleaning. This feature obviates the need for costly filters and reduces costly downtime.

In order to return the stem collector 10 from the open position shown in FIG. 6, the operator need only slide the outer canister 14 linearly forward until outer canister mounting ring threads 160 engage housing rear outer threads 162. Once the threads engage, the operator simply rotates the outer canister to engage the threads and lock the outer canister in the closed position. It will be apparent to one of skill in the art that a number of quick connectdisconnect arrangements may be used in lieu of the threads described herein.

The fastener stem collection apparatus of the present invention has been disclosed in conjunction with a power blind riveter. One of skill in the art will appreciate that it can also be used in conjunction with other fastening devices, such as those for applying lockbolt fasteners.

What is claimed is:

1. A stem collection apparatus for a power operated fastening device having means for separating stems from fasteners, comprising:

a housing selectively attachable to the fastening device;

an ejection tube slidably disposed within said housing having a central bore therethrough leading rearward from the fastening device through which the stems can pass;

means for urging said ejection tube forward against the fastening device so that the ejection tube central bore forms therewith a continuous, unobstructed passage through which stems may pass;

means for introducing pressurized fluid into the central bore so that the pressurized fluid flows away from the fastening device thereby urging the stem from the fastening device rearward through the central bore;

an inner collector tube for collecting the stems fixed to said housing rearward of said fastening device forming a first cavity therein in communication with said central bore, said inner collector tube having a tubular side wall throughout its length which is constructed to prevent the passage of said stems, through said side wall, and said collector tube having a stem outlet aperture at its rear end distal said fastening device; and an outer canister disposed about said inner collector tube having a window in the side thereof between the forward and rear end, a closed rear end distal the fastening device, said canister including holding structure which is selectively engageable in a forward position of said canister wherein said closed end covers said aperture to capture said stems and to prevent relative linear movement with respect to the inner collector tube or disengageable to allow moving the outer canister rearwardly away from said inner collector tube so that the rearwardly displaced outer canister forms a second cavity therein rearward of the first cavity and connected thereto by the inner collector tube rear aperture, thereby allowing discharge of stems from the cavity within the inner collector tube, through the second cavity and through the outer canister window.

2. The apparatus of claim 1, wherein said means for urging said ejection tube forward comprises pneumatic means.

3. The apparatus of claim 2, wherein said ejection tube forms an annulus between said housing and said ejection tube and has an enlarged front end providing a greater reactive surface in the rearward facing direction than in the forward facing direction, a jet passage through a side thereof allowing fluid communication between the annulus and central bore, and seal means for preventing escape of fluid from the annulus except for through the jet passage so that the pressurized fluid within the annulus biases the ejection tube, urging the ejection tube forward.

4. A stem collection apparatus for a power operated fastening device having means for separating stems from fasteners, comprising:

a passage leading rearward from the fastening device through which the stems can pass;

an inner collector tube for collecting the stems disposed rearward of said passage forming a first cavity therein in communication with said passage, said inner collector tube having an aperture at its rear end distal said passage; and an outer canister disposed about said inner collector tube having a window in the side thereof between the forward and rear end, a closed rear end distal the fastening device, and a forward end proximate the fastening device including means which is selectively engageable to prevent relative linear movement between said outer canister and said inner collector tube or disengageable to allow moving the outer canister closed end linearly rearward away from the inner collector tube rear aperture and moving the outer canister window linearly rearward away from said inner collector tube so that the rearwardly displaced outer canister forms a second cavity therein rearward of the first cavity and connected thereto by the inner collector tube rear aperture, thereby allowing discharge of the stems from the cavity within the inner collector tube, through the inner collection tube rear aperture, through the second cavity and through the outer canister window, said canister including structure which limits the rearward movement of said canister with respect to said collector tube so that said cavities remain in communication when said stems are being removed from the second cavity.

5. The apparatus of claim 4, further comprising a housing selectively and fixedly attachable to the fastening device, the forward end of said inner collector tube being fixedly attached to said housing, and the forward end of said outer canister being selectively affixable to said housing so that the outer canister may be easily manually manipulated to free the forward end from the housing and move said outer canister linearly rearward.

6. The apparatus of claim 5, wherein said outer canister comprises a cylindrical canister body with an open forward end, a metallic disk fixed to the rear end for resisting the impact and wear produced by stems striking the canister rear end, and a threaded mounting ring having an inner diameter smaller than the canister body interior for affixation to said housing.

7. The apparatus of claim 5, wherein said inner collector tube comprises a generally cylindrical member having internal threads at the forward end for affixation to said housing and an enlarged outer diameter at the rear end thereof to restrict rearward linear movement of the outer canister.

8. The apparatus of claim 4, wherein said outer canister is of opaque polymeric material.

9. The apparatus of claim 4, wherein said inner housing is of non-opaque polymeric material.

10. A stem collection apparatus for a power operated fastening device having means for separating stems from fasteners, comprising:

a non-opaque inner collector tube connected to said fastening device forming a cavity therein and having an inlet aperture for collecting stems, and an outlet aperture in one end of the tube for discharging said stems, said tube being otherwise sufficiently closed to prevent said stems from escaping; and an opaque outer canister movably arranged about said inner collector tube having an aperture on the side thereof for allowing viewing of the stems in the inner collector tube cavity and selective discharge of the stems by rearward retraction of said outer canister with respect to said inner collector tube, from a forward closed position to a rearward open position wherein said tube outlet aperture is open, and said canister including means, operable by a user of the apparatus, for releasbly holding said canister in its forward position.

11. The apparatus of claim 10, wherein said inner collector tube is of non-opaque polymeric material.

12. The apparatus of claim 11, wherein said polymeric material is transparent acrylic.

13. The apparatus of claim 10, wherein said outer canister is of opaque polymeric material.

* * * * *